United States Patent [19]

Barr

[11] Patent Number: 4,977,844

[45] Date of Patent: Dec. 18, 1990

[54] LIFE STEP STABILIZER

[76] Inventor: Richard Barr, 258 Centennial Drive, Renfrew, Ontario, Canada, K7V 4J1

[21] Appl. No.: 450,035

[22] Filed: Dec. 13, 1989

Related U.S. Application Data

[63] Continuation of Ser. No. 209,687, Jun. 21, 1988, abandoned.

[30] Foreign Application Priority Data

Jun. 3, 1988 [CA] Canada ..... 568616

[51] Int. Cl.[5] ..... B63B 27/14

[52] U.S. Cl. ..... 114/123; 114/362

[58] Field of Search ..... 114/61, 123, 362, 347

[56] References Cited

U.S. PATENT DOCUMENTS

| | | | |
|---|---|---|---|
| 1,132,924 | 3/1915 | Gepack . | |
| 1,369,670 | 2/1921 | Kauffman . | |
| 1,417,824 | 5/1922 | Haack | 114/123 |
| 1,710,625 | 4/1929 | Kapigian . | |
| 2,585,599 | 2/1952 | Tchetchet | 114/61 |
| 3,537,417 | 11/1970 | Beckner | 114/123 |
| 3,763,813 | 10/1973 | Holtz | 114/123 |
| 4,136,414 | 1/1979 | Popkin | 9/2 |
| 4,222,136 | 9/1980 | Valentino | 5/443 |
| 4,512,277 | 4/1985 | Williams | 114/123 |
| 4,687,447 | 8/1987 | Hannappel | 114/123 |
| 4,719,872 | 1/1988 | Ritten | 114/362 |

FOREIGN PATENT DOCUMENTS

| | | | |
|---|---|---|---|
| 743359 | 9/1966 | Canada | 114/123 |
| 318119 | 1/1920 | Fed. Rep. of Germany | 114/362 |
| 315906 | 3/1934 | Italy | 114/123 |

*Primary Examiner*—Sherman Basinger
*Assistant Examiner*—Stephen P. Avila
*Attorney, Agent, or Firm*—Price, Heneveld, Cooper, DeWitt & Litton

[57] ABSTRACT

A safety device for small water craft, especially canoes, comprising an extensible stabilizing float of the outrigger-type. The float is shaped to conform to the side of the hull and is stored thereagainst while transporting or portaging the canoe or traveling in the canoe in moderate weather. The stabilizing float is deployed whenever stability is required, permitting one to stand in the canoe or haul objects from the water without fear of tipping. In the preferred embodiment, a deployable step is also provided to assist a person overboard in reentering the craft.

7 Claims, 3 Drawing Sheets

LIFE STEP STABILIZER

This is a continuation of Ser. No. 07/209,687, filed June 21, 1988 now abandoned.

BACKGROUND OF THE INVENTION

The present invention relates to canoes and more particularly to an outrigger-type stabilizing device which is normally stored along the hull and deployed only when circumstances warrant.

Canoes have been in general use since before recorded history. Because of their speed, manoeuvrability and shallow draft, these craft continue to be in great demand by hunters, fisherman and boating enthusiasts. Canoes are, however, inherently unstable and are easily overturned even in calm water by inexperienced canoeists. Unfortunately, canoeing accidents account for the loss of many lives each year. Several attempts have been made to render canoes safer to use. For instance, canoes are now generally equipped with positive flotation to keep the craft afloat even after it has overturned and filled with water. Although this is effective in moderate weather and warm water conditions, it is practically impossible to re-enter the canoe, and in cold water a person can quickly suffer from hypothermia and lose his/her grip on the canoe.

One approach to providing stability is the use of an outrigger and, of course, outrigger canoes have also been known for centuries. However these craft are too unwieldy and difficult to transport to have gained popular acceptance by the general public and they are unsuited for navigating narrow creeks and brushy portages.

Extendible and retractable pontoons for stabilizing ships and aeroplanes forced to land on water have been described in U.S. Pat. No. 1,710,625 issued Apr. 23, 1929 to Haig Kapigian. In Kapigian's arrangement, gear driven telescoping tubes support pontoons which may be extended away from opposed sides of a ship, aeroplane or lifeboat in times of rough weather to reduce the rolling of the vessel and may be retracted to improve the speed of the vessel in moderate conditions. Although Kapigian's teachings are theoretically adaptable to canoes and other light craft, the mechanism required is expensive to construct, difficult to deploy and impractically complex for use with a canoe.

The present invention provides a retractable stabilizer of the outrigger type for small single-hulled craft, which is of simple and economical construction and easy to use, and in a preferred embodiment of the inventiion there is provided a combination stabilizer and step which may be deployed together to stabilize the craft and allow a person to embark or disembark from the water without assistance and without fear of the craft overturning.

It is an especial advantage of the invention that its simple and economical construction enables the stabilizer or combination of stabilizer and step to be sold as a kit for attachment to an existing canoe. Alternatively, a canoe may be fitted with same during its construction.

BRIEF DESCRIPTION OF THE INVENTION

In general terms, the invention comprises an elongated stabilizing float which is horizontally displacable from the side of a canoe to provide stability and inhibit the craft from tipping or overturning. The float is attached to a telescoping rod which permits the deployment thereof whenever circumstances warrant. In a preferred embodiment of the invention, the stabilizer is also provided with a boarding step which may be pivoted over the side of the canoe when the float is deployed to provide a convenient means for a person overboard to reenter the canoe.

In more specific terms, the invention comprises a stabilizing safety apparatus for small single hulled water craft comprising:

- at least one elongated float arranged substantially parallel with a side of the craft;
- extensible means interconnecting the float and the craft; the float being thereby manually displacable from a first position adjacent the hull of the craft to a second position remote from the hull; and
- locking means to releasably retain the float in both the first and second positions.

The invention will now be explained by way of example only and with reference to the following drawings wherein:

DETAILED DESCRIPTION OF THE INVENTION

Figure 1:
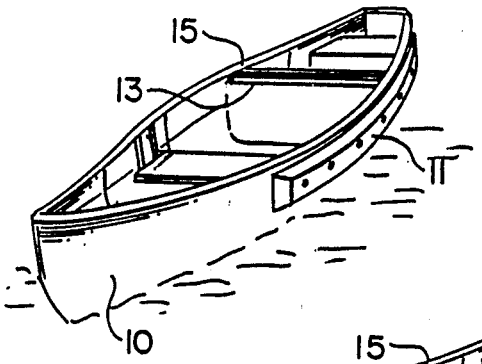
FIG. 1 is a perspective view of a canoe equipped with a stabilizing float in accordance with one embodiment of the invention, the stabilizing float being shown in its retracted position.
Figure 2:
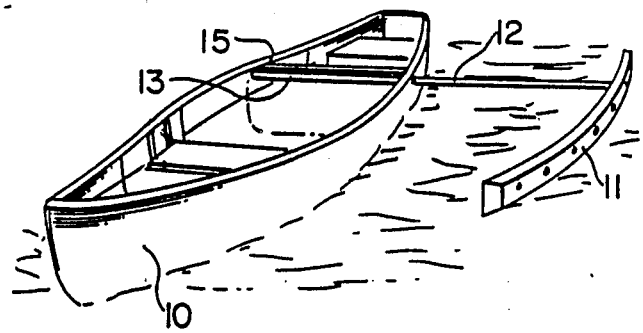
FIG. 2 is a perspective view of the canoe of FIG. 1 with the stabilizing float in its deployed or extended position.
Figure 3:
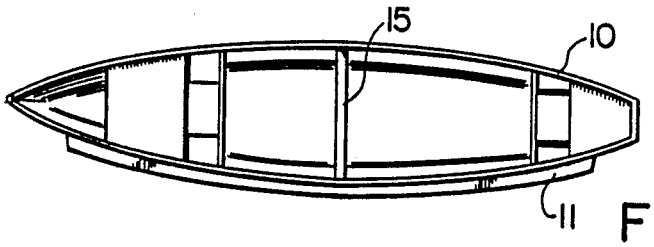
FIG. 3. is a plan view of the canoe as shown in FIG. 1.
Figure 4:
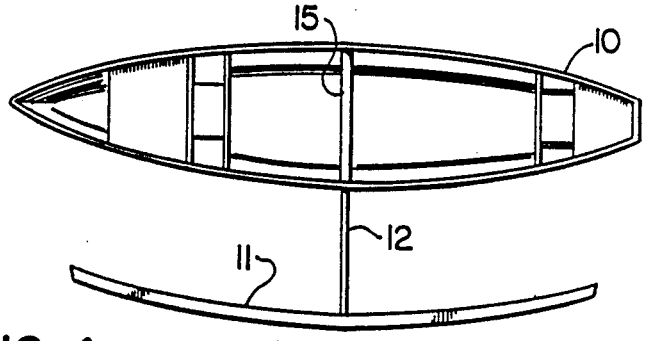
FIG. 4 is a plan view of the canoe as shown in FIG. 2.
Figure 5:
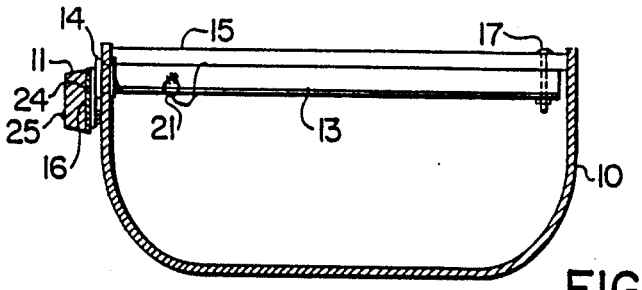
FIG. 5 is a schematic cross-sectional view of a canoe having the embodiment of the invention as shown in FIGS. 1 to 4 with the stabilizing float in its retracted position.

The drawings illustrate a canoe 10 having an extensible stabilizing float 11. In FIGS. 1 and 3, the float is shown retracted against the side of the hull and in FIGS. 2 and 4, the float is shown in its extended position. From the latter figures, it may be seen that the float 11 is secured to an inner arm assembly 12 which telescopes into an outer sleeve 13. The sleeve 13 extends across the beam of the canoe and in this embodiment of the invention is located directly beneath the central thwart 15 of the canoe. The inner arm assembly 12 extends from the sleeve 13 through a face plate 14 surrounding a hole cut in the side of the hull (FIG. 5).

Locking mechanisms, which will be described in greater detail below, are provided to releasably maintain the float in both its extended and retracted positions.

Figure 6:
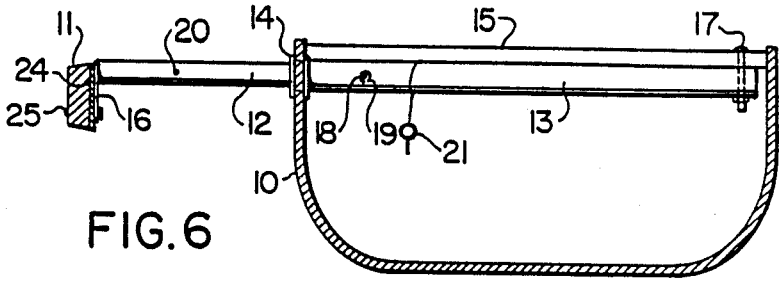
FIG. 6 is a schematic cross-sectional view of a canoe having the embodiment of the invention as shown in FIGS. 1 to 4 with the stabilizing float in its deployed position.

The float 11 is shaped to conform to the contour of the hull, so that in its retracted position, it fits snugly thereagainst. The float is constructed from a suitable flotation material preferably having structural integrity as well as good flotation properties attached to a contoured metal rib 24 with rivets or bolts 25 (FIG. 6). An especially suitable flotation material is foamed polyethylene or a similar durable foamed plastic.

Referring further to FIG. 6, a mounting plate 16 is welded to the outboard end of the inner arm assembly 12. The plate 16 is provided with a pair of mounting holes, complementary holes being provided in the float rib 24, by means of which the float 11 is bolted to the mounting plate 16.

In the embodiment of FIGS. 1 to 6, the outer sleeve 13 is suspended from the central thwart 15 which extends amidship between the gunnels of the canoe. The outer sleeve 13 is attached to the thwart 15 by a bolt 17 which is positioned far enough from the open end of the sleeve 13 to permit the inner arm 12 to fully retract into the sleeve. The open end of the sleeve 13 passes through the hull and is affixed to the face plate 14 which is bolted to the hull.

The inner arm assembly 12 has a spring mounted bullet latch 18 (see FIG. 6) secured thereto near its inboard end. The latch is urged by a spring into engagement with a hole 19 in the sleeve 13 when the float 11 is in its extended position. The hole 19 also registers with a second, diametrically opposed hole (not illustrated) in the sleeve 13 and both of these holes register with a hole 20 extending through the inner arm assembly 12 and located so that they are in registry when the inner arm is fully retracted into the sleeve. The inner arm and float are thus releasably locked in the extended position by means of the bullet latch 18 and, in the retracted position, by means of a pin 21 which can be inserted through the diametrically opposed holes 19 in the sleeve 13 and the hole 20 through the inner arm 12 which is placed in registry therewith.

Figure 7:
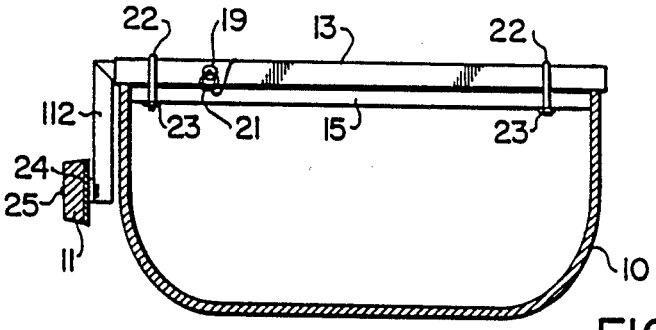
FIG. 7 is a schematic view of an alternative embodiment of the invention with the float shown in its retracted position.
Figure 8:
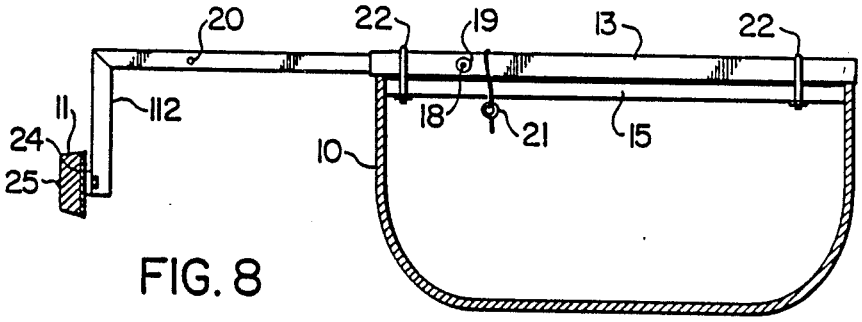
FIG. 8 is a schematic view of the embodiment illustrated in FIG. 7 with the stabilizing float shown in its deployed position.

Referring now to FIGS. 7 and 8, an alternative embodiment of the invention is illustrated which may be installed on practically any canoe without modifications to the boat. In this embodiment, the stabilizing float 11 is bolted to an inner arm assembly 112. As in the embodiment described above, the inner arm assembly 112 slides in and out of the outer sleeve 13. In this embodiment, however, the sleeve 13 rests atop the central thwart 15 of the canoe and is secured thereto by a pair of U-bolts 22 which pass through complementary holes in steel plates 23. Inner arm assembly 112 is formed to project downwards at right angles on its outboard end to compensate for the high mounting position of the outer sleeve 13. In other respects this embodiment of the invention is identical to the one previously described. FIG. 7 shows the stabilizer in its retracted position and FIG. 8 shows the stabilizer in its deployed or extended position. This embodiment of the invention has the advantage of being installable in minutes by persons with no mechanical skill. It also provides a stabilizer which may be shared among several canoes which are not in concurrent use.

Figure 9:
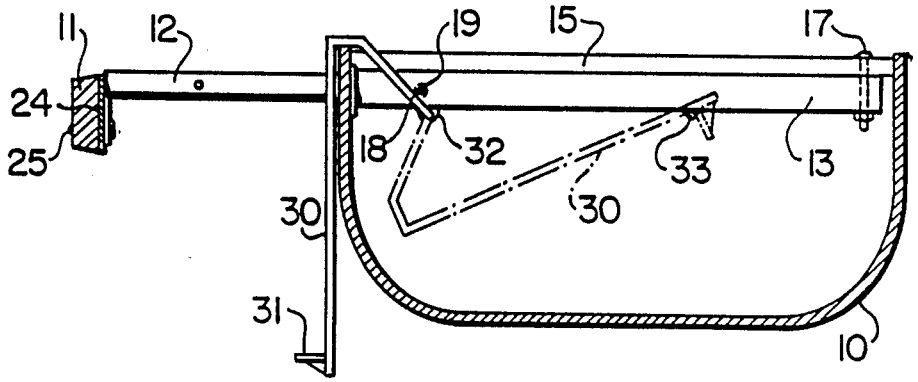
FIG. 9 is a schematic view of a further embodiment of the invention wherein the stabilizer is provided with a deployable boarding step to assist a person overboard in reembarking the craft, the boarding step being shown in bold lines in its deployed position and in ghost lines in its retracted position.

FIG. 9 illustrates another aspect of the invention wherein a boarding step 31 is provided to assist a person overboard in re-entering a canoe. The boarding step may be attached to either embodiment of the invention. For the purpose of example, it is shown in combination with the first described embodiment. It comprises a step leg 30 which is pivotally secured on its one end to a hinge pin 32. Hinge pin 32 is welded transversely to outer sleeve 13 and projects beyond one longitudinal edge of the sleeve to provide a mounting for the step leg 30. Boarding step 31 may thus be rotated, when float 11 is deployed, to its position illustrated in solid lines in FIG. 9. When not in use, step 31 is rotated inboard and rests on a pin 33 also welded in a similar fashion to the outer sleeve 13.

In use, the float 11 of the invention is stored against the side of the canoe 10 while the canoe is being transported or portaged. Generally it is not deployed when traveling any distance over the water in the canoe during moderate weather conditions.

The float 11 is gainfully deployed whenever stability is required in a canoe. The stabilizer permits one to stand in the canoe, lean over the side of the craft to hoist objects form the water or to stabilize the craft in rough weather or white water. If an accident occurs and a canoe tips or overturns, dumping the occupants overboard, there is an excellent chance of survival when the canoe is provided with a stabilizer in accordance with the invention. Once the canoe is righted, the float is quickly deployed by a person in the water. This is accomplished by pulling pin 21 and sliding the float 11 outwards manually until bullet latch 18 engages hole 19 in outer sleeve 13 to lock the float in its deployed position. The canoe may then be re-entered without fear of tipping. Re-entry into the canoe is especially facilitated with the embodiment of the invention provided with the deployable boarding step 31 illustrated by FIG. 9. Boarding step 31 allows even the most unathletic of individuals to enter a canoe from the water without undue difficulty.

In the case of a disaster such as a fire on a canoe, the stabilizing float 11 and inner arm assembly 12 (or 112, as the case may be) are quickly and easily disengaged from the canoe. This is accomplished by first removing pin 21 and extending the inner arm assembly until bullet latch 18 engages hole 19. The bullet latch is then depressed while applying outward pressure on the inner arm assembly. Once the bullet latch 18 has passed its registry with the hole 19 in the outer sleeve 13, the inner arm assembly is free to disengage from the outer sleeve. Thus disengaged, the float 11 can be used to provide significant floatation which permits the canoeists to reach shore provided weather conditions are not too severe and the water is not too cold.

Even though the stabilizing float 11 is provided on only one side of the craft, it actually provides excellent resistance to the tipping of a canoe in the opposite direction. This resistance to tipping toward the side of the canoe opposite the float is provided more as a result of the surface tension created by the elongated surface of the float in contact with the water than by the weight of the float itself.

Although the invention was principally designed for use with canoes, it is of course adaptable to any small single hulled water craft and contributes significantly to the safety of the use thereof.

The embodiments of the invention in which an exclusive property or privilege is claimed are defined as follows.

I claim:

1. A stabilizing safety apparatus for small, single hulled water craft having a water line comprising:

at least one elongated float normally disposed above the water line along a side of the craft;

extensible means interconnecting said float and the craft for manually displacing said float from a first position above the water line adjacent the hull of the craft to a second position remote from and substantially parallel with the hull; and locking means for releasably retaining said float in at least said first and second positions;

said extensible means comprising an inner arm slidably displaceable within an outer sleeve, said outer sleeve being attached transversely to said hull and including a pair of diametrically opposed radial bores on one end thereof for engagement with said locking means, said inner arm being provided on one end region adjacent said float with a radial bore which registers with the holes in said outer sleeve when said float is in said first position and further provided on its opposite end with a pin having limited radial travel to and from the periphery of said inner arm, said pin being constantly urged outwardly by spring means to engage one of said holes in said outer sleeve when said float is in said second position.

2. The apparatus of claim 1 wherein the flotation material of said float comprises foamed polyurethane.

3. The apparatus of claim 1 wherein the longitudinal face of said float adjacent the side of the hull is shaped to substantially conform to the contour of the hull.

4. An apparatus as in claim 1 wherein said float comprises an elongated member of flotation material which is substantially rectangular in cross section and is attached to a rigid reinforcing rib.

5. The apparatus of claim 1 wherein said outer sleeve is attached on said one end to a face plate pierced with a bore in axial alignment with a complementary horizontal bore through a side of the craft, said outer sleeve being parallel with and mounted on its opposite end to the underside of a thwart of the craft, said inner arm comprising an elongated linear member provided on its one end with means for the attachment of said float.

6. The apparatus of claim 1 wherein said outer sleeve is parallel with and attached to the upper side of a thwart of the craft, said inner arm having on said one end a short section which extends downwardly substantially parallel with an outer side of the craft, said short section being provided on its free end with means for the attachment of said float.

7. A stabilizing safety apparatus for small, single hulled water craft comprising:

at least one elongated float arranged substantially parallel with a side of the craft;

extensible means interconnecting said float and the craft for manually displacing said float from a first position adjacent the hull of the craft to a second position remote from said hull;

locking means for releasably retaining said float in said first and second positions;

a boarding step means for assisting a person in the water in embarking the craft including an elongated member pivotally mounted to said extensible means so as to be movable from a location substantially within the craft to a location substantially parallel to and adjacent an outer side of the craft, the lower end of said member projecting below the water line in said second location, and tread means affixed to the lower end region of said member for stepping into the craft; said elongated member including an elongated tread support arm which is substantially U-shaped on its one end and pivotally mounted on said end to a pin affixed transversely to said extensible means so that said tread support part is pivotable from a location adjacent to, parallel with and substantially beneath said extensible means to a location substantially normal to said extensible means and parallel with a side of the craft, the bottom region of said U-shaped end resting on a gunnel of the craft in said second location, said tread means including a rectangular tread on said lower end of said elongated member and attached transversely thereto, said tread being beneath the water line when said tread support arm is in its second said location.

* * * * *